US009114910B1

(12) United States Patent
Schommer

(10) Patent No.: US 9,114,910 B1
(45) Date of Patent: Aug. 25, 2015

(54) MIXING CONTAINER

(71) Applicant: Joel Schommer, Brainard, NE (US)

(72) Inventor: Joel Schommer, Brainard, NE (US)

( * ) Notice: Subject to any disclaimer, the term of this patent is extended or adjusted under 35 U.S.C. 154(b) by 0 days.

(21) Appl. No.: 14/264,567

(22) Filed: Apr. 29, 2014

(51) Int. Cl.
*B65D 25/08* (2006.01)
*B65D 21/08* (2006.01)

(52) U.S. Cl.
CPC ..... *B65D 25/087* (2013.01); *B65D 21/086* (2013.01)

(58) Field of Classification Search
CPC . A61J 1/2093; B65D 21/086; B65D 25/0897; B65D 81/3211; B65D 81/3222; B65D 85/8043; B65D 25/087
USPC ..... 206/221, 222; 215/6, DIG. 8; 426/112, 426/115, 117, 119, 120
See application file for complete search history.

(56) References Cited

U.S. PATENT DOCUMENTS

| | | | | | |
|---|---|---|---|---|---|
| 1,706,335 | A | * | 3/1929 | Toch | 206/221 |
| 2,494,294 | A | * | 1/1950 | Greenberg | 206/221 |
| 2,545,302 | A | * | 3/1951 | Perez Lias | 206/221 |
| 3,856,138 | A | * | 12/1974 | Maekawa et al. | 206/221 |
| 4,682,689 | A | | 7/1987 | Pereira et al. | |
| 5,170,888 | A | | 12/1992 | Goncalves | |
| 5,685,422 | A | | 11/1997 | Kim | |
| 6,103,280 | A | * | 8/2000 | Molzahn et al. | 426/112 |
| 6,113,257 | A | | 9/2000 | Sharon et al. | |
| 7,066,323 | B1 | | 6/2006 | Reisman | |
| 7,377,383 | B2 | | 5/2008 | Henry | |
| 7,591,221 | B2 | * | 9/2009 | Ho | 206/221 |
| 7,690,534 | B2 | | 4/2010 | Revenu | |
| 8,083,056 | B1 | * | 12/2011 | Wu | 206/221 |
| 8,104,611 | B2 | * | 1/2012 | Helou, Jr. | 206/221 |
| 8,172,079 | B2 | | 5/2012 | Greenberg et al. | |
| 8,365,960 | B1 | | 2/2013 | Kalaouze | |
| 8,394,439 | B2 | * | 3/2013 | Karabinis | 215/6 |
| 8,875,874 | B2 | * | 11/2014 | Helou, Jr. | 206/221 |
| 2009/0294397 | A1 | * | 12/2009 | Wu | 215/6 |
| 2013/0026124 | A1 | * | 1/2013 | Wu | 215/6 |

FOREIGN PATENT DOCUMENTS

| | | | | |
|---|---|---|---|---|
| CA | 2477920 | A1 | * | 2/2006 |
| FR | 2982249 | A1 | * | 5/2013 |
| WO | WO 2009105262 | A1 | * | 8/2009 |

* cited by examiner

*Primary Examiner* — Bryon Gehman
(74) *Attorney, Agent, or Firm* — Dennis L. Thomte; Thomte Patent Law Office LLC

(57) ABSTRACT

A container which includes a first container member having a second container member selectively removably positioned therein. The first container member has a liquid therein such as soda. The second container member has a liquid therein such as liquor. The bottom of the second container member opens when the second container member is pulled upwardly and outwardly of the first container member so that the liquor mixes with the soda.

2 Claims, 3 Drawing Sheets

MIXING CONTAINER

BACKGROUND OF THE INVENTION

1. Field of the Invention

This invention relates to a container for keeping two liquid products separate therein and for the mixing of the two products at the time of use. More particularly, this invention relates to a container wherein a smaller container member containing liquor or the like is removably positioned within a larger container member containing soda or the like. Even more particularly, this invention causes the mixing of the two liquids upon the removal of the smaller container member from the larger container member.

2. Description of the Related Art

Many types of dual compartment containers have been provided to maintain two liquids therein from being mixed until time of consumption. However, the dual compartment containers of the prior art are difficult and expensive to manufacture. Further, the dual compartment containers of the prior art are not convenient to use.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A container for keeping two products therein separate and for the mixing of the products at the time of use is disclosed. The container includes a first container member having a generally cylindrical body with a bottom and a tapered upper shoulder terminating in a neck, having upper and lower ends, with the neck having external threads thereon. A cap having internal threads formed thereon is designed for attachment to the external threads on the neck. The container also includes an elongated second container member with upper and lower ends positioned in the first container member. The second container member includes an elongated upper end portion positioned in the neck of the first container member. The upper end portion of the second container member has a semi-circular cross-section. The upper end of the upper end portion of the second container is positioned at the upper end of the neck of the first container member. The upper end portion of the second container member has a length which is greater than the length of the neck of the first container member so that the lower end of the upper end portion of the second container is positioned below the lower end of the neck of the first container member. The second container has a tapered portion, having upper and lower ends, which extends downwardly from the lower end of the upper end portion of the second container member. The second container member includes a cylindrical body, having upper and lower ends, which extends downwardly from the lower end of the tapered portion of the second container member. The lower end of the cylindrical body of the second container member is closed by a disc-like member which is fixed to the bottom of the first container member. The first container member is filled with soda or the like. The second container member is filled with a liquor or the like.

A resilient seal seals the upper end of the upper end portion of the second container member. A pull tab is secured to the upper end of the upper end portion of the second container member whereby upward movement of the pull tab will cause the cylindrical body of the second container member to break away from the disc-like member thereof thereby permitting the liquid in the second container member to mix with the liquid in the first container member as the second container member is pulled upwardly and outwardly from the first container member.

It is therefore a principal object of the invention to provide an improved container for keeping two products separate therein and for the mixing of the products at the time of use.

A further object of the invention is to provide a container of the type described which is readily and easily manufactured.

A further object of the invention is to provide a container of the type described which enables two products to remain separate and for the mixing of the products at the time of use which is easy to use.

A further object of the invention is to provide a device of the type described which is economical of manufacture, durable in use and refined in appearance.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

FIG. 2 is a partial sectional view of the container of this invention which illustrates a liquid such as soda or the like being poured into the first container member and which shows the second container member being filled with a liquid such as liquor or the like.

DESCRIPTION OF THE PREFERRED EMBODIMENT

Figure 1:
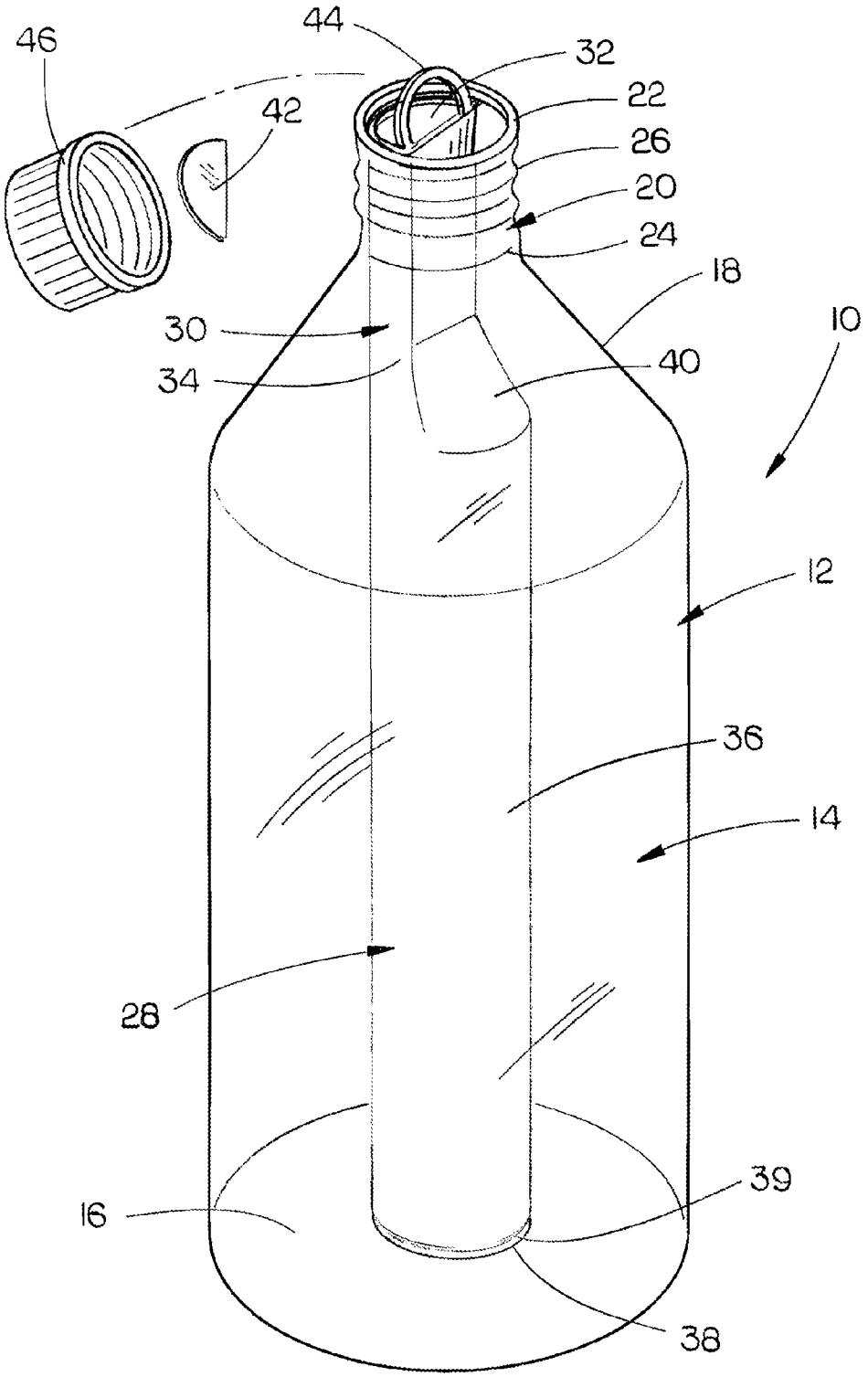
FIG. 1 is a perspective view of the container of this invention.
Figure 2:
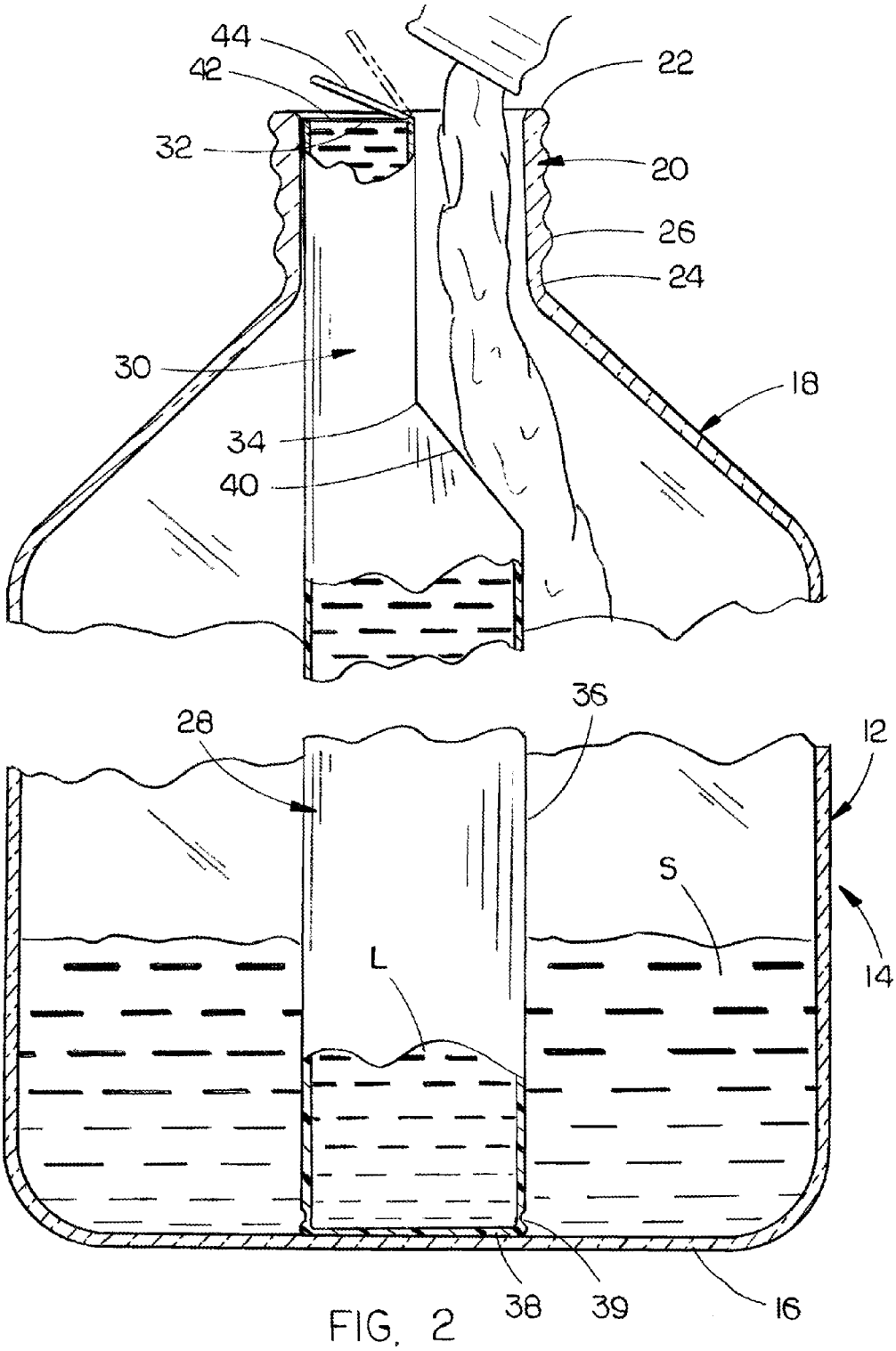
Figure 3:
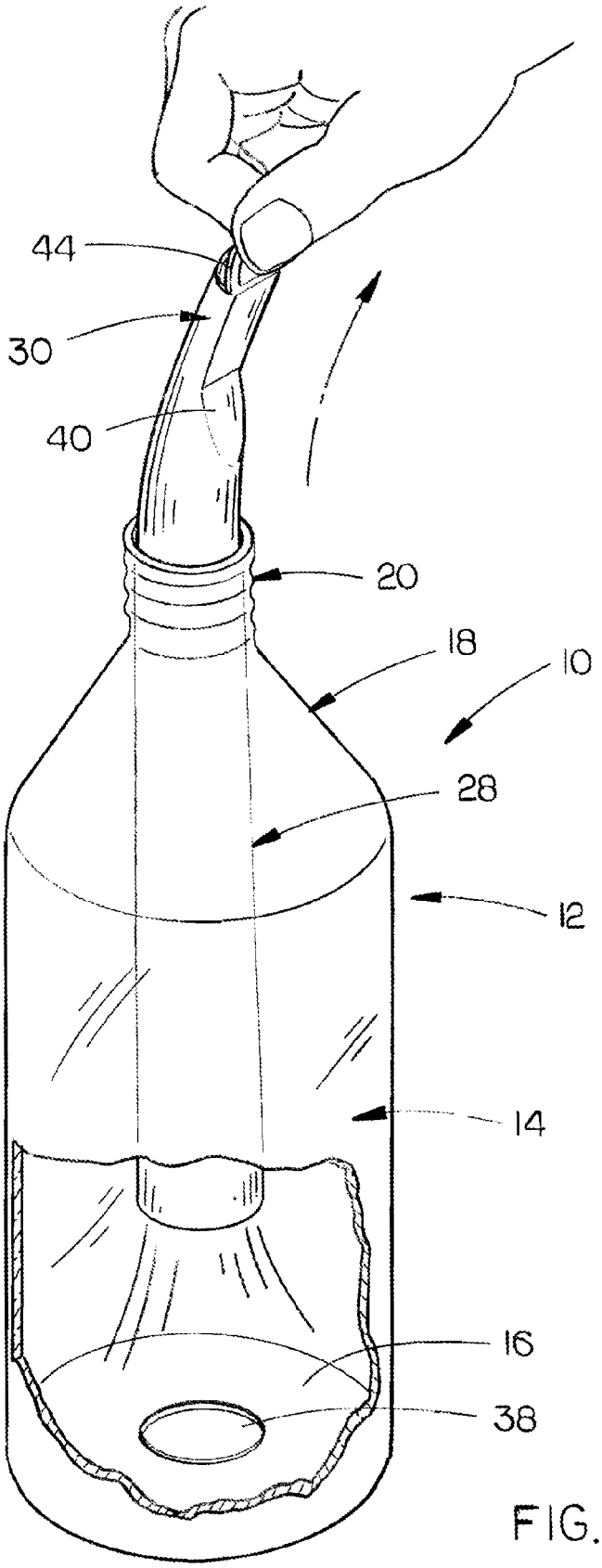
FIG. 3 is a partial perspective view illustrating the second container member being removed from the first container member so that the liquid in the second container member is mixed with the liquid in the first container member.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The dual compartment container of this invention is referred to by the reference numeral 10. Container 10 includes a first container member 12 which will normally be in bottle or jug form and comprised of glass or plastic. Container member 12 includes a generally cylindrical body 14 with a bottom 16 and a tapered upper shoulder 18 terminating in a conventional neck 20 having an upper end 22 and a lower end 24. The neck 20 has external threads 26 formed thereon.

The numeral 28 refers to a second container member which is positioned within container member 12. Container member 28 will normally be comprised of a plastic material. Container member 28 includes an elongated upper end portion 30 which is positioned in neck 20 and which has an open upper end 32 and an open lower end 34. The open upper end 32 of upper end portion 30 dwells in approximately the same plane as the upper end 22 of neck 20. The lower end 34 of upper end portion 30 is positioned below the lower end 24 of neck 20. As seen in FIG. 1, the upper end portion 30 has a semi-circular cross-section so that the upper end portion 30 only occupies one-half of the interior of neck 20.

Container member 28 also includes a cylindrical body 36 having a disc-like bottom 38 which closes the lower end of the container member 28 and which is affixed to bottom 16 of container member 12. Preferably, the periphery of bottom 38 is weakened or thinned at 39 for a purpose to be explained in detail hereinafter. Container member 28 also has a tapered or transition portion 40 which extends between the upper end of body 36 and the lower end 34 of upper end portion 30. The outside diameter of body 36 is slightly less than the inside diameter of neck 20 so that the container member 28 may be pulled upwardly and outwardly from the container member 12 as will be described in detail hereinafter.

During the manufacture of the container 10, the container members 12 and 28 may be separately molded or made be molded together at the same time. Assuming that the container members 12 and 28 are separately molded, the container member 28 will be extended downwardly into the container member 12 with the bottom 38 of container member 28 being affixed by any convenient means to bottom 16 of container member 12. The container member 12 is then filled with liquid such as soda S or the like. The container member 28 is then filled with liquor L such as whiskey, rum, etc. The upper end of end portion 30 of container member 28 is then sealed with a resilient semi-circular disc 42. A pull tab 44 is secured to the upper end of container member 28. A cap 46 having internal threads is then secured to neck 20 to seal the upper end of the open portion of neck 20. In some cases, the disc 42 may not be used.

When it is desired to mix the contents of the liquids within container members 12 and 28, the cap 46 is unscrewed from the neck 20. The disc 42 is removed. The pull tab 44 is then pulled upwardly which causes the lower end of body 36 of container member 28 to separate from bottom 38 at the weakened or thinned portion 39 of the periphery of the bottom 38. The upward movement of the container member 28 with respect to the container member 12 causes the liquid within container member 28 to be drained from container member 28 and mixed with the liquid within the container member 12 (FIG. 4). The container member 28 is pulled completely out of the container member 12. The mixture may then be dispensed through the neck 20. The cap 40 may be replaced on the neck 20 so that the mixture may be consumed later.

It can therefore be seen that a novel means has been provided for mixing the contents of first and second container members at the time the mixture is to be consumed. It can be seen that a person desiring to consume the mixture does not have to carry separate containers of soda and liquor to the location where the mixture is to be consumed. The container described herein is relatively simple of manufacture and easy to use. It can therefore be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A container for keeping first and second liquid products separate therein and for the mixing of the first and second liquid products at the time of use, comprising:

a first container member including a generally cylindrical body, having an upper end, a lower end, a bottom, and a tapered upper shoulder, having an upper end and a lower end, with said upper end of said tapered upper shoulder terminating in an elongated neck having an upper end and a lower end, with said neck having external threads thereon;

said first container member configured to contain the first liquid product;

a cap having internal threads formed thereon for attachment to said external threads on said neck;

an elongated second container member, having an upper end and a lower end, positioned in said first container member;

said second container member configured to contain the second liquid product thereon;

said second container member including an elongated upper end portion positioned in said neck of said first container member;

said elongated upper end portion of said second container member having an upper end and a lower end;

said elongated upper end portion of said second container member having a semi-circular cross-section;

said upper end of said elongated upper end portion of said second container member being positioned at said upper end of said neck;

the distance between said upper end and said lower end of said elongated upper end portion of said second container member being greater than the distance between said upper end and said lower end of said neck so that said lower end of said elongated upper end portion of said second container member is positioned below said lower end of said neck;

said second container member having a tapered portion, having an upper end and a lower end, which extends downwardly from said lower end of said elongated upper end portion of said second container member;

said second container member including a cylindrical body, having an upper end and a lower end, which extends downwardly from said lower end of said tapered portion of said second container member;

said lower end of said cylindrical body of said second container member being closed by a disc member which is fixed to said bottom of said first container member;

a resilient seal sealing said upper end of said upper end portion of said second container member; and and a pull tab secured to said upper end of said upper end portion of said second container member whereby upward movement of said pull tab will cause said cylindrical body of said second container member to break away from said disc member thereby permitting the second liquid product in said second container member to mix with the first liquid product in said first container member as said second container member is pulled upwardly and outwardly from said first container member.

2. A container for keeping, first and second liquid products separate therein and for the mixing of the first and second liquid products at the time of use, comprising:

a first container member including a generally cylindrical body, having an upper end, a lower end, a bottom, and a tapered upper shoulder, having an upper end and a lower end, with said upper end of said tapered upper shoulder terminating in an elongated neck having an upper end and a lower end, with said neck having external threads thereon;

said first container member configured to contain the first liquid product;

a cap having internal threads formed thereon for attachment to said external threads on said neck;

an elongated second container member, having an upper end and a lower end, positioned in said first container member;

said second container member configured to contain the second liquid product thereon;

said second container member including an elongated upper end portion positioned in said neck of said first container member;

said elongated upper portion of said second container member having an upper end and a lower end;

said elongated upper end portion of said second container member having a semi-circular cross-section;

said upper end of said elongated upper end portion of said second container member being positioned at said upper end of said neck;

the distance between said upper end and said lower end of said elongated upper end portion of said second container member being greater than the distance between said upper end and said lower end of said neck so that said lower end of said elongated upper end portion of said second container member is positioned below said lower end of said neck;

said second container member having a tapered portion, having an upper end and a lower end, which extends downwardly from said lower end of said elongated upper end portion of said second container member;

said second container member including a cylindrical body, having an upper end and a lower end, which extends downwardly from said lower end of said tapered portion of said second container member;

said lower end of said cylindrical body of said second container member being closed by a disc member which is fixed to said bottom of said first container member;

and a pull tab secured to said upper end of said upper end portion of said second container member whereby upward movement of said pull tab will cause said cylindrical body of said second container member to break away from said disc member thereby permitting the second liquid product in said second container member to mix with the first liquid product in said first container member as said second container member is pulled upwardly and outwardly from said first container member.

* * * * *